United States Patent [19]

Lang

[11] Patent Number: 4,549,050

[45] Date of Patent: Oct. 22, 1985

[54] ILLUMINATED CONTROL KNOB FOR ELECTRIC SWITCH

[75] Inventor: Paul R. Lang, Sterling Heights, Mich.

[73] Assignee: General Motors Corporation, Detroit, Mich.

[21] Appl. No.: 622,540

[22] Filed: Jun. 20, 1984

[51] Int. Cl.[4] ..... H01H 9/16

[52] U.S. Cl. ..... 200/314; 200/310; 200/312; 200/313

[58] Field of Search ..... 200/310, 312–314, 200/316, 317

[56] References Cited

U.S. PATENT DOCUMENTS

| | | | |
|---|---|---|---|
| 2,109,790 | 3/1938 | Batcheller | 200/316 |
| 2,953,668 | 9/1960 | Bassett, Jr. | 200/313 |
| 4,359,618 | 11/1982 | Stevens | 200/314 |

*Primary Examiner*—Stephen Marcus
*Assistant Examiner*—Renee S. Kidorf
*Attorney, Agent, or Firm*—Edward J. Biskup

[57] ABSTRACT

An electric switch having a pair of light bulbs located in tandem with one light bulb serving to light the outer peripheral edge of a control knob for indicating location of the switch in the dark and the other light bulb serving to light the control knob center for providing a system status.

3 Claims, 3 Drawing Figures

ILLUMINATED CONTROL KNOB FOR ELECTRIC SWITCH

This invention concerns electric switches and more particularly relates to a hand-operated electric switch which can be located in the dark and indicates system status.

More specifically, the electric switch according to the present invention includes a pair of light bulbs, one of which serves as a switch locator when lighted and the other of which serves as a function indicator when lighted. In the preferred form, the switch comprises a tubular housing adapted to be mounted on a support panel and has a manually operable control knob located therein for movement between a first position and a second position. The control knob is made of a light transmitting plastic material and is provided with an enlarged outer end and an inner end. A cylindrical opening is centrally formed in and extends through the control knob along the longitudinal center axis thereof and a function indicator lens closes the outer end of the opening. The inner and outer surfaces of the control knob are provided with shielding means while the peripheral edge of the enlarged outer end of control knob is unshielded so when one of the light bulbs is illuminated, the light rays therefrom travel initially through the plastic material of the control knob along a path parallel to the aforementioned longitudinal center axis of the control knob after which the light rays are bent 90° and emitted from the aforementioned peripheral edge of the control knob. In this manner, the control knob is outlined with light so under low visibility conditions, the control knob is visible and can be readily located on the support panel. The other of the light bulbs is positioned in the control knob so as to cause the light rays emitted therefrom to illuminate the function indicator lens without causing any of the light rays to travel into the light transmitting plastic material of the control knob. Finally, a switch module is operatively connected to the inner end of the control knob so when the latter is moved to the first position, contacts within the switch module can be momentarily closed and an electric circuit controlling for example, a parking brake is energized, and the energized condition of the circuit is indicated by the other of the light bulbs being illuminated, the light rays of which are visible through the function indicator lens of the control knob.

The objects of the present invention are to provide a new and improved electric switch which controls energization of an electric circuit and which includes a control knob formed so as to provide a light pipe for lighting the edge of the control knob and also has a center opening closed by a lens which provides a lighted signal when the circuit is energized; to provide a new and improved electric switch having a plastic control knob provided with shielding means for directing light towards the outer peripheral edge of the control knob so as to facilitate location of the control knob in the dark; to provide a new and improved electric switch for an instrument panel of a vehicle that has a pair of light bulbs located in tandem with one light bulb serving to light the outer edge of a control knob for indicating the location of the switch in the dark and the other light bulb serving to light the control knob center for providing system status; and to provide a new and improved electric switch for a vehicle instrument panel and having an illuminated push/pull control knob which indicates the location of the switch in the dark when the instrument panel lights are in the "on" position and also indicates the state of operation of the switch.

Other objects of the present invention will be more apparent from the following detailed description when taken with the drawings in which.

Figure 1:
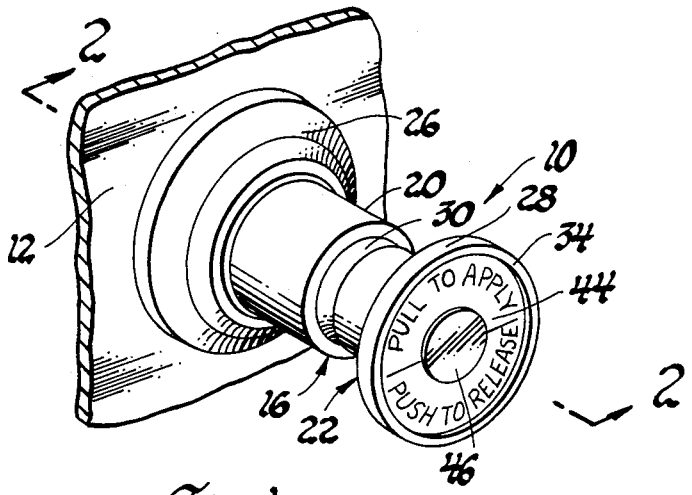
FIG. 1 is an isometric view showing an electric switch made in accordance with the present invention mounted in a support panel such as the instrument panel of a vehicle.
Figure 2:
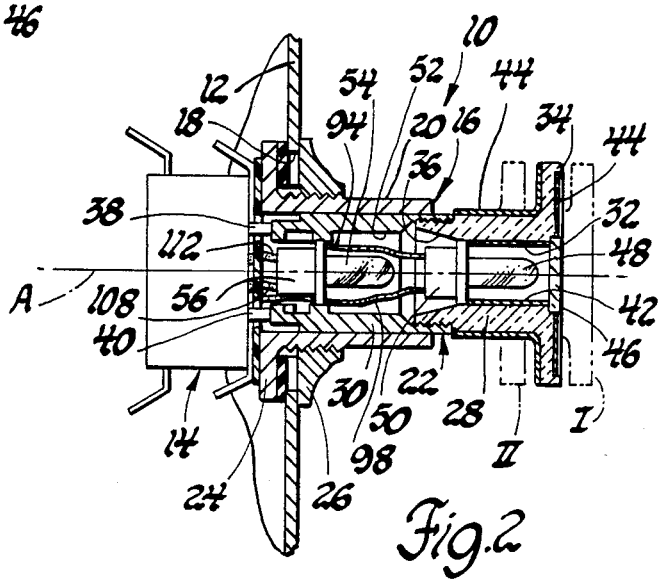
FIG. 2 is a longitudinal sectional view of the electric switch taken on line 2—2 of FIG. 1.

Referring to the drawings and more particularly FIGS. 1 and 2 thereof, an electric switch 10 made in accordance with the present invention is shown mounted in a support panel 12 such as the instrument panel of a motor vehicle. The electric switch 10, in general, comprises a switch module 14 and an actuator assembly 16 which are mechanically interconnected and axially aligned so as to facilitate mounting as a unit within a circular opening 18 formed in the support panel 12.

More specifically the actuator assembly 16 includes a tubular housing 20 which supports a control knob 22 for axial movement from the neutral position shown in full lines in FIG. 2 to an "apply" position shown in phantom lines and indicated by the Roman Numeral I and a "release" position shown in phantom lines and indicated by the Roman Numeral II. The housing 20 has the inner end thereof formed with an annular flange 24 which cooperates with a ferrule 26 for securing the actuator assembly 16 to the panel 12 so as to locate the longitudinal center axis A of the electric switch 10 horizontally as shown in FIG. 2.

The control knob 22 is formed from two axially aligned members 28 and 30 which are threadably interconnected. The member 28 is made of a light transmitting plastic material, such as Lucite, having a cylindrical opening 32 formed therethrough along the longitudinal center axis A. The outer end of the member 28 is formed with an enlarged circular head, the peripheral portion of which has an integral axially and forwardly extending rim portion 34 for purposes to be explained below. The inner end of the member 28 is formed with a tapered or frusto-conical surface 36 and is threadably connected to the outer end of the cylindrical member 30, the inner end of which is secured to a pair of plungers 38 and 40 of the switch module 14. The entire inner surface of the opening 32 formed in the member 28, except for the tapered surface 36, is provided with shielding means 42 which can take the form of a metallized coating of a reflective material such as aluminum. Likewise, the outer surface of the member 28 is provided with similar type of coating or shielding means 44 along the axially extending outer surface and along the opposite vertical sides of the enlarged head of member 28 except for the rim portion 34 which is not coated or provided with any form of shielding means.

A disc type lens member 46, made of a translucent plastic material, closes the outer open end of the cylindrical opening 32 and serves as a function indicator that is adapted to be illuminated by a light bulb 48 mounted in an electric socket 50. The socket 50 completely closes the inner open end of the cylindrical opening 32 and is fixed therein as shown in FIG. 2. The member 30 is made from an opaque material and has a cylindrical opening 52 formed therethrough the center of which is located along the longitudinal center axis A of the actuator assembly 16. The cylindrical opening 52 is concentrically and axially aligned with the cylindrical opening 32 formed in the member 28 and supports a light bulb 54 located within an electric socket 56. The socket 56 is suitably connected to the member 30 so as to fix the light bulb 54 in the position shown in FIG. 2 relative to the socket 50. Thus, as seen in FIG. 2, the light bulbs 54 and 48 are axially aligned and centrally located in their respective cylindrical openings 52 and 32 in the members 28 and 30 and adapted to maintain their positions relative to the members 28 and 30 and relative to each other.

The switch module 14 is fixed to the tubular housing 20 of the actuator assembly 16 and is of a conventional type and, as aforementioned, has a pair of outwardly extending plungers 38 and 40 which in this case are rigidly connected to member 30 of the control knob 22. As shown schematically in FIG. 3, the plungers 38 and 40 serve to move a pair of spaced switch blades 56 and 58 which respectively cooperate with contact members 60 and 62 and contact members 64 and 66 for selectively energizing a pair of solenoids 68 and 70 located on the opposite sides of a control valve 72. A spring 74 located within switch module 14 normally biases the switch blades 56 and 58 and, in turn, the control knob 22 towards the neutral position shown in full lines in FIGS. 2 and 3. This ocurs due to the rigid connection between the plungers 38 and 40 and the member 360 of the control knob 22, it being understood that the plungers 38 and 40 are connected to the switch blades 56 and 58 and move therewith. Thus, it should be apparent that when the control knob 22 is in the full line position of FIGS. 2 and 3, both sets of contacts 60, 62 and 64, 66 are open and it is only when the control knob 22 is manually pulled to the right to the phantom line position indicated by the Roman Numeral I that the contacts 64 and 66 are closed, and only when the control knob 22 is moved inwardly to the phantom line position indicated by the Roman Numeral II that the contacts 60 and 62 are closed.

Figure 3:
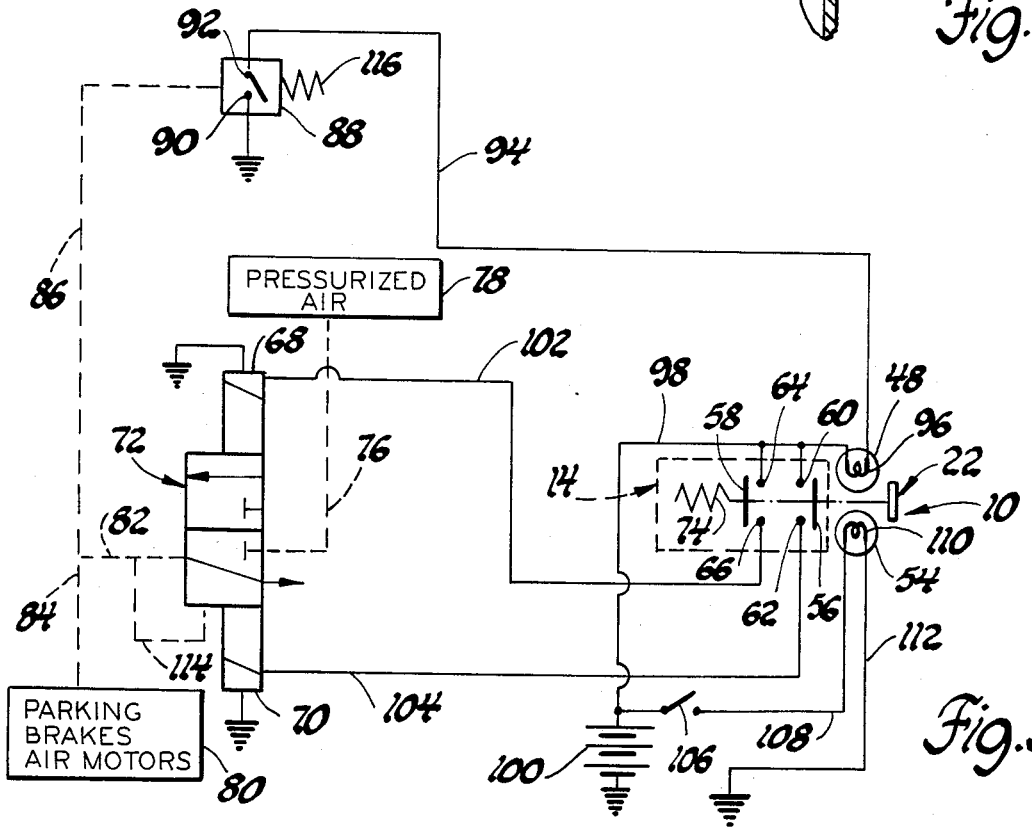
FIG. 3 is a schematic diagram of an air-operated parking brake system controlled by an electric circuit which incorporates the electric switch shown in FIGS. 1 and 2.

In this regard, it will be noted that FIG. 3 schematically shows an air-operated parking brake system of a vehicle combined with an electric circuit incorporating the electric switch 10 which serves to control operation of the parking brake system. The control valve 72 is connected via an air line 76 to a source 78 of pressurized air and is also connected to the brake air motors 80 of the vehicle through air lines 82 and 84. A pilot air line 86 extends between the air line 82 and a pressure-operated switch 88 which has one contact 90 thereof connected to ground and the other contact 92 connected by a conductor 94 to one side of the filament 96 of the light bulb 48. The other side of the filament 96 is connected by a conductor 98 to the contacts 60 and 64 which are connected to the positive side of a battery 100. Also, the contact 66 is connected by conductor 102 to the solenoid 68 while the contact 62 is connected by a conductor 104 to the solenoid 70. It will be noted that the light bulb 54 is located in an electric circuit separate from the parking brake electric circuit and is intended to be energized whenever the instrument panel lights of the vehicle are lighted. Accordingly, as seen in FIG. 3, a separate switch 106 for the instrument panel lights is provided which is in series with the light bulb 54 and is connected thereto by a conductor 108 which connects to one side of a filament 110 of the bulb 54, the other side of the filament 110 being connected by a conductor 112 to ground.

From the above description it should be apparent that when the instrument panel lights of the vehicle are energized by closing the switch 106, the light bulb 54 is connected to the battery and is lighted. As seen in FIG. 2, when the light bulb 54 is lighted, the light rays therefrom will enter the inner end of the member 28 at the tapered surface 36 thereof and travel axially therethrough and then bend 90° at the enlarged head of the member 28 and be emitted radially and also axially forwardly from the rim portion 34. The lighting of light bulb 54 will create somewhat of a halo effect around the enlarged head of the member 28 and serve to outline the latter and facilitate location of the control knob 22 in the dark. It will be understood that the shielding means 42 and 44 on the inner and outer surfaces of the member as well as the socket 50 which closes the inner end of the opening 32, will assure that the light rays emitted by the light bulb 54 will travel only through the member 28 as explained above and not be visible through the lens 46. Thus, when it is desired to apply the parking brakes of the vehicle, the vehicle operator can readily find the control knob 22 in the dark and merely has to pull outwardly on the control knob 22 to apply the brakes. Since the control knob 22 is biased by the spring 74 towards a neutral position, as soon as the vehicle operator releases the control knob 22 it again assumes the full line vertical position shown in FIGS. 2 and 3. It will be noted, however, that when the control knob 22 is pulled to the right to the phantom line position indicated by Roman Numeral I, the contacts 64 and 66 are momentarily closed by the blade 58 resulting in the solenoid 68 being connected to battery 100 via conductor 98 and therefore energized so as to shift the spool valve of the control valve 72 in position and connect the source 78 of pressurized air with the parking brake air motors 80. A pilot line 114 is provided for maintaining the spool valve in the shifted position. As the pressurized air flows to the parking brakes air motors 80 via lines 82 and 84, the pressurized air also flows via pilot line 86 to the pressurized-operated switch 88 to close the latter and energize the light bulb 48. Thus, the light bulb 48 is lighted and remains lighted so long as the parking brake motors 80 are connected to the source 78 of pressurized air. As seen in FIG. 2 when the light bulb 48 is lighted, the light rays therefrom will illuminate the translucent lens 46 and provide a visible signal to the vehicle operator that the parking brakes are applied. If the vehicle operator desires to release the parking brakes, he merely pushes the control knob 22 inwardly, or to the left as seen in FIG. 2, so as to momentarily close the contacts 60 and 62 by the blade 56 when the control knob 22 assumes the position indicated by the Roman Numeral II. This movement results in the solenoid 70 being connected to battery 100 via conductor 98, switch blade 56, and conductor 104 and thus being energized. The energization of the solenoid 70 overcomes the pilot line air pressure maintaining the spool valve in the position previously described and causes the spool valve to return to the closed full line position shown in FIG. 3 cutting off communication between the source 78 of pressurized air and the air motors 80 of the braking system. As a consequence, pressurized air is also cut off to the pressure-operated switch 88 so as to cause a spring 116 employed therewith to return the switch 88 to the open position resulting in deenergization of the light bulb 48. This then serves as another visible signal to the vehicle operator that the brakes have been released.

Various changes and modifications can be made in this construction without departing from the spirit of the invention. Such changes and modifications are contemplated by the inventor and he does not wish to be limited except by the scope of the appended claims.

The embodiments of the invention in which an exclusive property or privilege is claimed are defined as follows.

1. An electric switch including a pair of light bulbs one of which serves as a switch locator when lighted and the other of which serves as a function indicator when lighted, said switch comprising a tubular housing adapted to be mounted on a support panel, a control knob mounted within said housing for manual movement between a first position and a second position, said control knob having a portion thereof made of a light transmitting plastic material and having an enlarged outer end and an inner end, an opening centrally formed in and extending through said control knob along a longitudinal center axis thereof, a function indicator lens closing the outer end of said opening, said control knob having the outer and inner surfaces thereof provided with shielding means so as to provide a light pipe through said light transmitting plastic material so when said one of said lights is illuminated the light rays therefrom travel initially through the plastic material of the control knob along a path parallel to said longitudinal center axis after which the light rays are bent 90° and emitted from the peripheral edge and a rim portion of the outer end of said control knob, said other of said light bulbs being positioned in said control knob so that said shielding means causes the light rays emitted by said other of said light bulbs to illuminate said function indicator lens without causing any light to travel into said enlarged outer end of said control knob, and contact means operatively associated with said control knob so when the latter is moved to said first position said other of said light bulbs is illuminated and when said control knob is moved to said second position said other of said light bulbs is extinguished.

2. An electric switch including a pair of light bulbs one of which serves as a switch locator when lighted and the other of which serves as a function indicator when lighted, said switch comprising a tubular housing adapted to be mounted on a support panel, a control knob mounted within said housing for manual movement between a first position and a second position, said control knob having a portion thereof made of a light transmitting plastic material and having an enlarged outer end and an inner end, an opening centrally formed in and extending through said control knob along a longitudinal center axis thereof, a function indicator lens closing the outer end of said opening, said control knob having the outer and inner surfaces thereof provided with light shielding means except for a surface at the inner end of said cotrol knob and the peripheral edge of said outer end of said control knob so when said one of said lights is illuminated the light rays therefrom enter said surface at the inner end of said control knob and travel initially through the plastic material of the control knob along a path parallel to said longitudinal center axis after which the light rays are bent 90° and emitted from said peripheral edge of the outer end of said control knob, said other of said light bulbs being positioned within said control knob so that said shielding means causes the light rays emitted by said other of said light bulbs to illuminate said function indicator lens without causing any light to travel into said enlarged outer end of said control knob, and contact means operatively associated with said control knob so when the latter is moved to said first position said other of said light bulbs is illuminated and when said control knob is moved to said second position said other of said light bulbs is extinguished.

3. An electric switch including a pair of light bulbs one of which serves as a switch locator when lighted and the other of which serves as a function indicator when lighted, said switch comprising a tubular housing adapted to be mounted on a support panel, a control knob mounted within said housing for manual movement between a first position and a second position, said control knob having the forward portion thereof made of a light transmitting plastic material and having an enlarged outer end and an inner end, an opening centrally formed in and extending through said control knob along a longitudinal center axis thereof, said one of said light bulbs being located within said opening to the rear of said light transmitting plastic material and said other of said light bulbs being located within said opening forwardly of said one of said light bulbs, a function indicator lens closing the outer end of said opening, said control knob having the outer and inner surfaces thereof provided with shielding means except for an annular surface at the inner end of said light tansmitting plastic material and the peripheral edge of said outer end of said control knob so when said one of said lights is illuminated the light rays therefrom enter said annular surface and travel initially through the plastic material of the control knob along a path parallel to said longitudinal axis after which the light rays are bent 90° and emitted from said peripheral edge of the outer end of said control knob, said other of said light bulbs being positioned in said control knob adjacent said inner shielding means so that the light rays emitted by said other of said light bulbs illuminate said function indicator lens without causing any light to travel into said enlarged outer end of said control knob, and contact means operatively associated with said control knob so when the latter is moved to said first position said other of said light bulbs is illuminated and when said control knob is moved to said second position said other of said light bulbs is extinguished.

* * * * *